US005507214A

United States Patent [19]

Hoshino

[11] Patent Number: 5,507,214

[45] Date of Patent: Apr. 16, 1996

[54] SNAPPY FOR THE SNARE DRUM

[75] Inventor: Yoshiki Hoshino, Aichi, Japan

[73] Assignee: Hoshino Gakki Co., Ltd., Japan

[21] Appl. No.: 366,234

[22] Filed: Dec. 29, 1994

[30] Foreign Application Priority Data

Aug. 11, 1994 [JP] Japan ..... 6-211863

[51] Int. Cl.[6] ..... G10D 13/02

[52] U.S. Cl. ..... 84/415

[58] Field of Search ..... 84/415, 416, 417

[56] References Cited

U.S. PATENT DOCUMENTS 2,085,819 7/1937 Meyer ..... 84/415

*Primary Examiner*—Cassandra C. Spyrou

*Attorney, Agent, or Firm*—Ostrolenk, Faber, Gerb & Soffen

[57] ABSTRACT

A snappy for a snare drum wherein the snare is caused to accurately and effectively contact the drum head. Both ends of the snare are fixed to a respective holding plate. A belt is installed in the holding plate and when the belt is either tightened or loosened, it causes the snare to respectively contact or become separated from the drum head surface. The holding plate that fixes and holds the snare has a V-shaped cross section including a rear plate part and a front plate part and a bend so that the plate is bent to the drum head. A belt engaging part protrudes down from the rear plate part near the bend and the belt is attached there. A snare is fixed on the radially inner side of the front plate part.

8 Claims, 3 Drawing Sheets

SNAPPY FOR THE SNARE DRUM

BACKGROUND OF THE INVENTION

The present invention relates to a snappy for a snare drum, and particularly for causing the snare to accurately and effectively contact the drum head.

In a snappy known in the prior art, as shown in FIGS. 7 and 8, the belt engaging part 71 of the plate 70 and the snare 60 supported on the plate 70 are both provided at the same height above the surface of the drum head of drum 90. As a consequence, even if the belt 80 engaged at the part 71 is pulled tight, the plate 70 moves radially outwardly of the drum head and parallel to the snare, without also bringing the snare 60 into tight contact with the drum head 91. In some cases, the snare 60 may not contact the drum head 91 at all.

SUMMARY OF THE INVENTION

The primary object of this invention is to cope with the above problems in the prior art.

A particular object is to effectively bring the snare into contact with the drum head as the snare is tensioned.

This invention relates to a snappy for a snare drum wherein both ends of the snare are fixed to respective holding plates located near the sides of the drum body and at the drum head. A belt attached to an end of the snare is inserted into a respective holding plate. When the belt is tightened or loosened, the snare respectively comes into contact with or separates from the face of the drum head on the lower side of the drum.

The holding plate is formed to have a cross section in the radial direction that is in the shape of a V defining a rear or outward and a front or inward part of the plate. The snare is attached to the front or inward plate part of the holding plate, while the rear or outward plate part bends up toward the drum head. A snare tightening belt has an engaging part which is attached to the rear plate part at a location below the plate and at the region where the plate is bent. A snare is fixed on the inner or drum head surface side of the front plate part.

Other objects, features and advantages of the present invention will become apparent from the following description of the invention which refers to the accompanying drawings.

BRIEF DESCRIPTION OF THE DRAWINGS

The invention is explained in detail below with reference to the attached drawings.

DESCRIPTION OF THE PREFERRED EMBODIMENT

Figure 1:
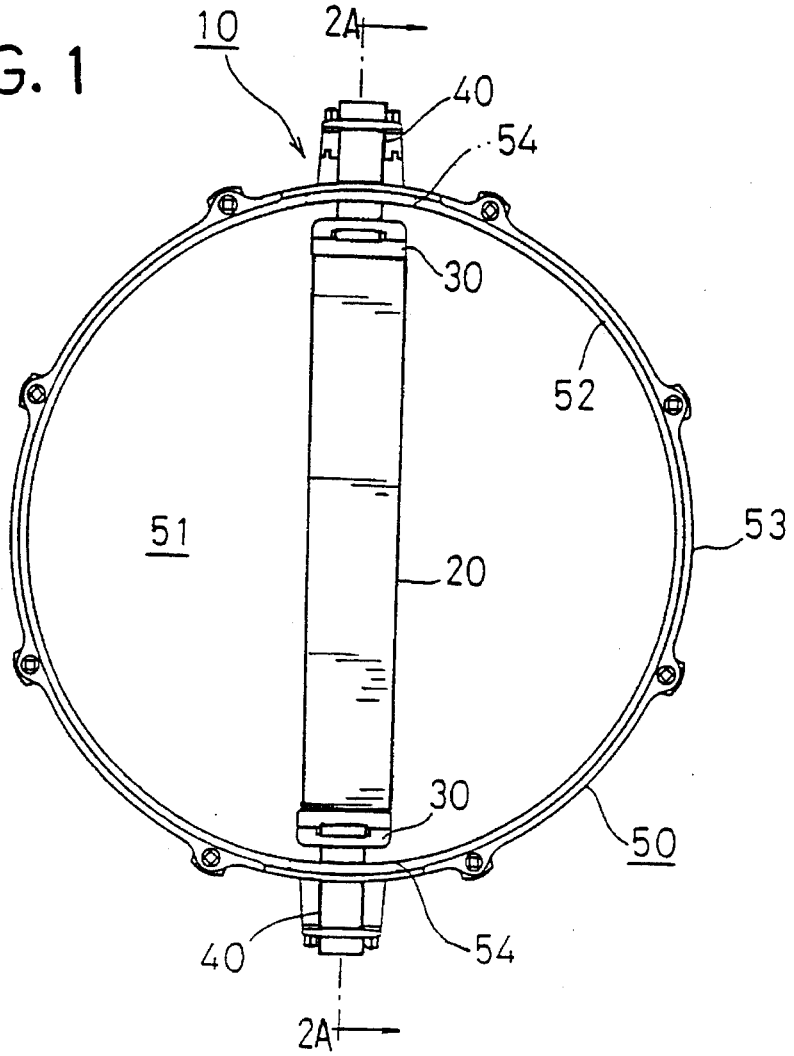
FIG. 1 is a top view of a drum that has a snappy according to this invention.
Figure 2:
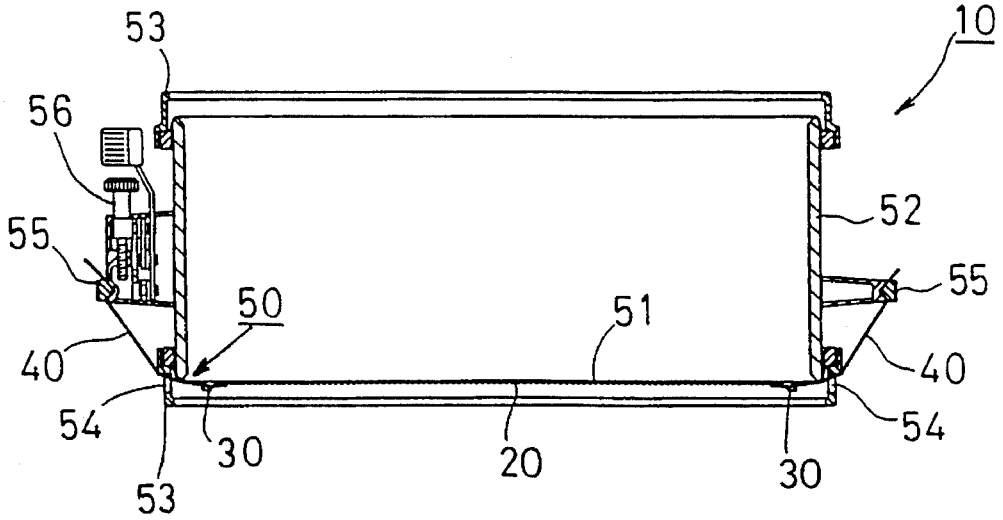
FIG. 2 is a side of a cross section view cut along line 2—2 in FIG. 1.

FIGS. 1 and 2 show a snappy 10 for a snare drum. The drum has a body 52 with a lower end 50 having a lower drum head 51 at that end. A drum hoop 53 around the bottom end of the drum body holds the drum head. A respective belt guide hole 54 is formed in the hoop for each belt 40, described below.

Both ends of a conventional snare 20 are fixed to a respective holding plate 30. A belt 40 is inserted into the holding plate 30. When the belt 40 is tightened or loosened, the snare 20 respectively comes into contact with or is separated away from the lower drum head 51. Each belt 40 passes through its guide hole 54 to a respective belt holding part 55. A tension adjusting bolt 56 on the drum body is adjusted to draw on the holding part to tighten the belt 40.

Figure 3:
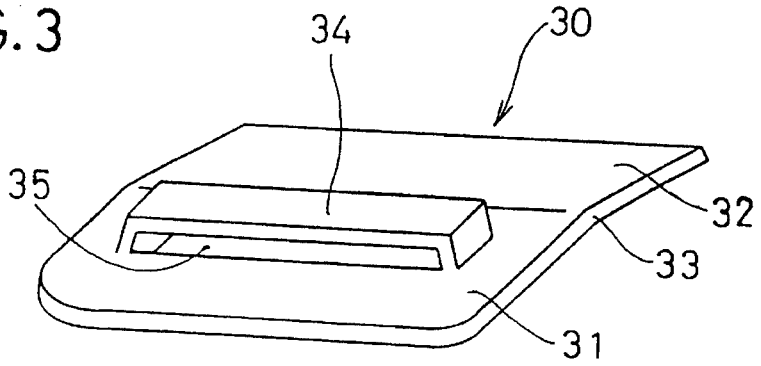
FIG. 3 is an oblique view of the plate of the snappy.

In FIG. 3, the plate 30 that fixes and holds the snare 20 has a V-shaped cross section, as seen in the radial direction outward of the drum body. It includes a rear plate part 31 radially outward and a front plate part 32 radially inward that at a bend at 33. The plate 30 is located toward a side of the drum head 51. The plate 30 has a belt engaging part 34, with a rear hole 35 and a front hole 36 in the neighborhood of the bend 33 of the rear plate part 31. The belt engaging part 34 projects outwardly below the plate 30 generally at the bend 33.

Figure 5:
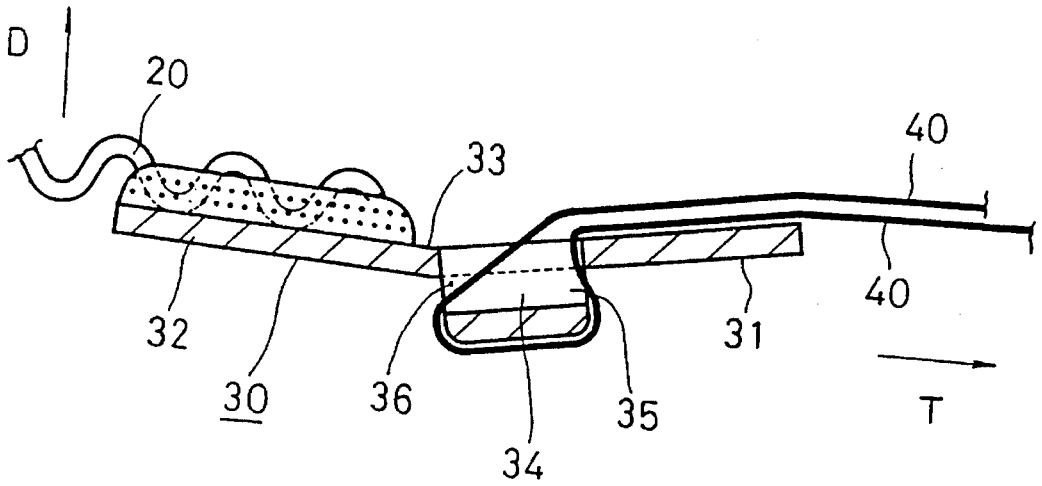
FIG. 5 is an enlarged view showing the essential part of the plate.

In FIG. 5, the belt engaging part 34 holds the belt 40 in a manner to enable an operator to freely tighten or loosen the belt, as the belt 40 is inserted into the rear hole 35 from the side of the drum head of the plate 30, and the outer periphery of the belt engaging part 34 is rotated. Next, the belt is inserted into the front part 36, thereby bringing the belt to the drum head side of the plate 30 again.

Figure 4:
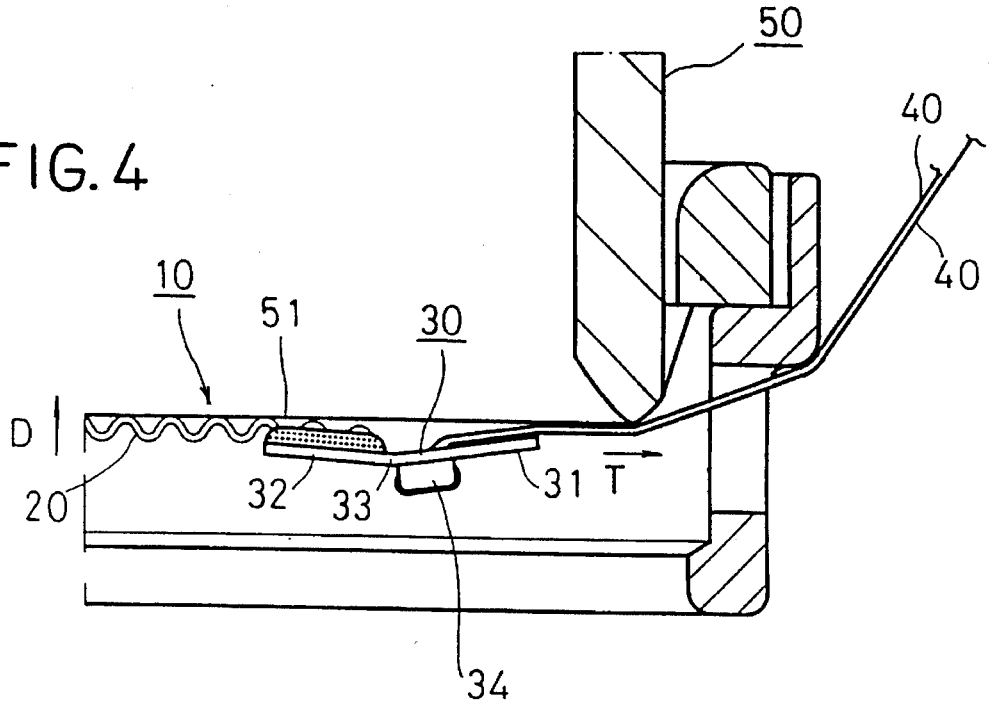
FIG. 4 is a cross section showing the plate installed.

A snare 20 is affixed, by welding, for example, to the inner surface side of the front plate 32, i.e., the side toward the drum head, as shown in FIGS. 4 and 5.

In FIG. 4, the belt engaging part 34 protrudes from the bend 33 of the holding plate 30 and down from the bend 30 so that the part 33 is the part of the plate farthest from the drum head. The belt 40 is arranged to pull the belt engaging part 34 from the outside side of the drum head which urges the part 34 toward the drum head. As a result, when the belt 40 is tensioned, the plate 30 produces a force component in the direction D perpendicular to the drum head, which is in addition to the force component in the direction T parallel with the drum head.

Figure 6:
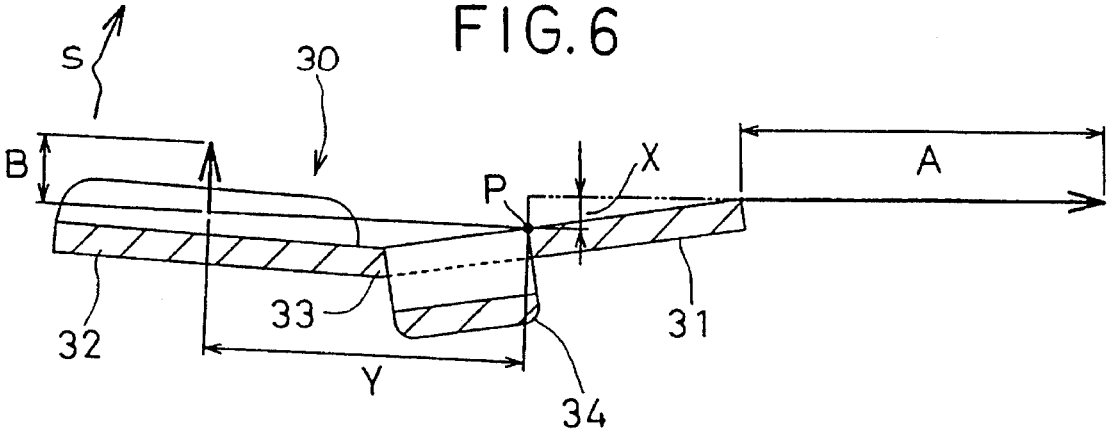
FIG. 6 is a conceptual view showing the functioning of the plate.
Figure 7:
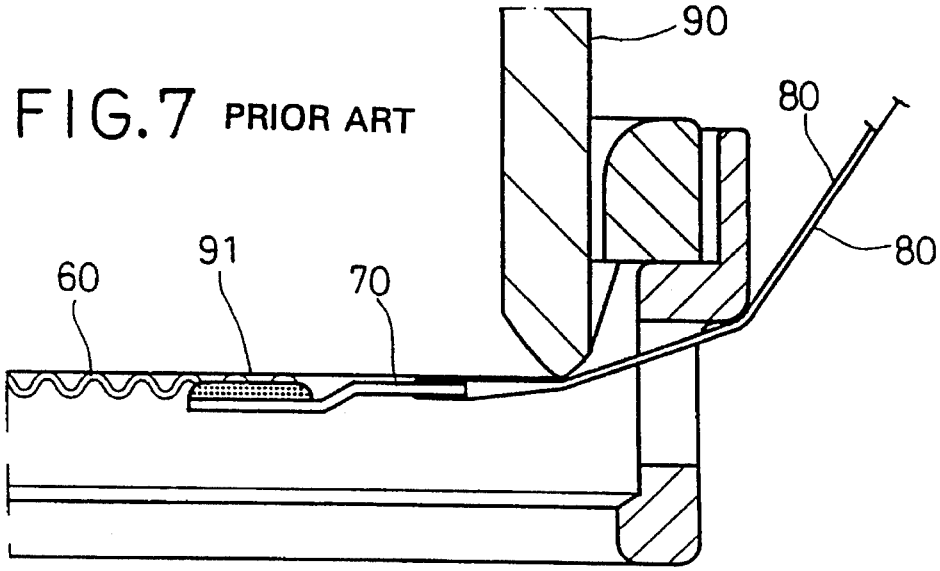
FIG. 7 PRIOR ART
FIG. 7 is a cross section showing the installed state of a plate which is to be used in the snappy for the snare drum according to prior art.
Figure 8:
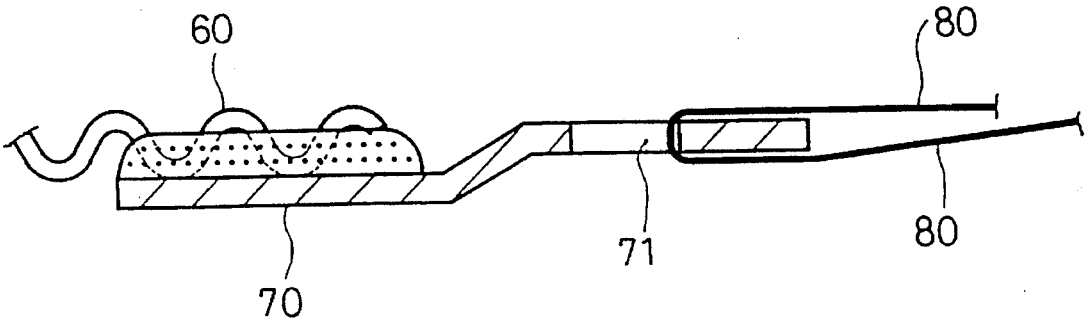
FIG. 8 PRIOR ART
FIG. 8 is an expanded cross section of the plate according to the prior art.

The combined force components appear as a force component in the direction S which rotate and lift the plate 30 in the direction of the drum head, as shown in FIG. 6, with the starting point P of the force component T in the tensile direction and the force component D toward the side of the drum head as the center, and the force component S that causes the snare 20, which is fixed to the front plate part 32, to contact the drum head 51.

The rotary force S can be adjusted by modifying the degree of the bend of the plate 30 or the lengths of the rear plate part 31 and the front plate part 32. For this adjustment, a formula expresses the mutual relationship:

$$A \times X = B \times Y$$

where A indicates the work power in the tensile direction, X is the length of the work power A in the tensile direction from the starting point P, B is the work power directed toward the drum head, and Y is the length of the work power B toward the drum head from the starting point P.

In one embodiment, X=0.8 mm, Y=8.8 mm and the invention is constructed in such a way that P may constitute a point of intersection between the rear or bottom surface of the belt engaging part 34 and the lower surface of the plate 30.

The snappy for a snare drum of the present invention makes it possible to cause the snare to firmly contact the drum head by forming the holding plate with a V-shaped cross section, thereby providing a difference in height, and providing a belt engaging part which protrudes in the neighborhood of the bend wherein that belt engaging part is the farthest part from the drum head in the holding plate. This can be accomplished without modifying the basic structure of the snappy. In addition, it becomes possible to effectively cause the snare to contact the drum head without dispersing the force by the tip of the front plate part.

Because the plate enables the snare to effectively contact the drum head, the tensile strength of the belt can be made smaller than for a snappy according to the prior art.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A snappy for a snare drum having a drum body, and a drum head over an end of the drum body, the snappy comprising:

a holding plate, adapted to be positioned toward an edge of the drum head, the holding plate having a front plate part and a rear plate part, the plate also having an inner side adapted to face toward the drum head and an outer side adapted to face outward from the drum head, the holding plate having a bend between the rear and front plate parts so that the planes of the front and rear plate parts are not parallel to each other;

a snare adapted for extending across the drum head, the snare having one end attached to the front plate part of the holding plate;

a belt engaging part disposed at the rear plate part of the holding plate;

a belt attached to the belt engaging part, the belt adapted to be tightened or loosened and thereby causes the snare to contact or separate from the drum head.

2. The snappy of claim 1, whereby the holding plate has a cross section in the shape of a V formed by the rear plate part, the front plate part and the bend.

3. The snappy of claim 1, wherein the belt engaging part is shaped to protrude below an outer side of the rear plate and the belt is so connected to the belt engaging part that tightening of the belt draws on the plate to move the snare toward the drum head.

4. The snappy of claim 3, wherein the belt engaging part is disposed below the rear plate part and toward the bend in the plate.

5. The snappy of claim 4, wherein the belt engaging part is so shaped that the belt extends over the rear plate part on the inner side thereof, and then down to the belt engaging part, such that tightening the belt pulls the plate to urge the snare both outward to tension the snappy and toward the drum head.

6. A snappy for a snare drum having a drum body and a drum head over an end of the drum body, the snappy comprising:

at least one holding plate having a front plate part and an adjacent rear plate part, a bend between the front plate part and the rear plate part so that the planes of the front plate part and the rear plate part are not coextensive;

a snare attached at one end to the front plate part of the holding plate;

a belt engaging part disposed at the rear plate part of the holding plate; and a belt attached to the belt engaging part of the holding plate.

7. The snappy of claim 6, wherein the bend between the front and rear plate parts is generally V shaped.

8. The snappy of claim 6, wherein there are two holding plates, each of the two holding plates attached to an end of the snare.

* * * * *